US009347165B2

(12) United States Patent
Kim et al.

(10) Patent No.: US 9,347,165 B2
(45) Date of Patent: May 24, 2016

(54) WASHING MACHINE

(71) Applicant: LG ELECTRONICS INC., Seoul (KR)

(72) Inventors: Chihyun Kim, Changwon-si (KR); Dahye Kim, Changwon-si (KR); Sungyong Eom, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 47 days.

(21) Appl. No.: 14/266,777

(22) Filed: Apr. 30, 2014

(65) Prior Publication Data

US 2014/0318190 A1 Oct. 30, 2014

(30) Foreign Application Priority Data

Apr. 30, 2013 (KR) ..... 10-2013-0048525

(51) Int. Cl.
*D06F 37/06* (2006.01)

(52) U.S. Cl.
CPC ..... *D06F 37/065* (2013.01)

(58) Field of Classification Search
None
See application file for complete search history.

(56) References Cited

U.S. PATENT DOCUMENTS

2013/0081432 A1* 4/2013 Choi et al. ..... 68/142

FOREIGN PATENT DOCUMENTS

| | | | |
|---|---|---|---|
| CN | 1616748 | A | 5/2005 |
| CN | 103031694 | A | 4/2013 |
| EP | 0 245 721 | A1 | 11/1987 |
| EP | 245721 | A1 * | 11/1987 |
| EP | 1 529 866 | A1 | 5/2005 |
| EP | 1529866 | A1 * | 5/2005 |
| EP | 1 816 250 | A1 | 8/2007 |
| EP | 2 270 272 | A1 | 1/2011 |
| EP | 2270272 | A1 * | 1/2011 |
| GB | 673887 | | 6/1952 |

OTHER PUBLICATIONS

European Search Report dated Sep. 9, 2014, issued in Application No. 14 16 6349.2.
Chinese Office Action issued in Application No. 201410183376.0 dated Dec. 3, 2015.

* cited by examiner

*Primary Examiner* — Michael Barr
*Assistant Examiner* — Cristi Tate-Sims
(74) *Attorney, Agent, or Firm* — Ked & Associates, LLP

(57) ABSTRACT

The washing machine includes a tub containing wash water, a drum, a lifter, and a partition. The drum rotates inside the tub and has at least one inlet to introduce wash water contained in the tub. The lifter forms a chamber holding wash water introduced through the inlet together with the drum and discharges wash water into the drum through a plurality of discharge holes arranged from a front side to a rear side inside the chamber during the rotation of the drum. The partition divides the chamber into a front chamber and a rear chamber along a longitudinal direction of the drum and forms an angle inclined with respect to a circumference of the drum.

21 Claims, 10 Drawing Sheets

WASHING MACHINE

CROSS-REFERENCE TO RELATED APPLICATION(S)

This application claims priority under 35 U.S.C. §119 to Korean Application No. 10-2013-0048525 filed on Apr. 30, 2013, whose entire disclosure is hereby incorporated by reference.

BACKGROUND

1. Field

The present application relates to a washing machine.

2. Description of the Related Art

Generally, a washing machine is an apparatus that performs washing, rinsing, and spinning cycles to remove contaminants from clothing and bedding (hereinafter, referred to as laundry) using water, detergent, and mechanical action.

The washing machine includes a tub containing wash water and a drum rotating while holding laundry. The drum rotates while being sufficiently filled with wash water such that laundry loaded therein can be soaked with wash water. The position of laundry is changed according to the operation pattern of the drum. Contaminants are removed from laundry by a chemical reaction of water and detergent or a physical force according to the position variation of laundry.

In a typical washing machine, when the drum rotates, a slight flow of wash water occurs. This is mainly caused by viscosity or friction between drum and wash water or the position change of laundry, but there is a limitation in evenly dissolving detergent in water.

Also, in order for laundry to be sufficiently soaked with water, the position change of laundry needs to be smoothly performed to allow laundry to be located at a lower part of the drum with a uniform probability. However, when a large amount of laundry exists in the drum, the position laundry is not sufficiently changed, making it difficult for laundry to be uniformly soaked. Accordingly, the drum should be operated for a longer time until the position of laundry is sufficiently changed, or should be supplied with much more water up to a higher level inside the drum.

BRIEF DESCRIPTION OF THE DRAWINGS

The embodiments will be described in detail with reference to the following drawings in which like reference numerals refer to like elements wherein:

FIGS. 7A and 7B are views illustrating a position change of a front lifter according to a rotation of a drum, in which FIG. 7A shows a position change during a forward rotation of the drum and FIG. 7B shows a position change during a backward rotation of the drum; and FIGS. 8A and 8B are views illustrating a position change of a rear lifter according to a rotation of a drum, in which FIG. 8A shows a position change during a backward rotation of the drum and FIG. 8B shows a position change during a forward rotation of the drum.

DETAILED DESCRIPTION

Figure 1:
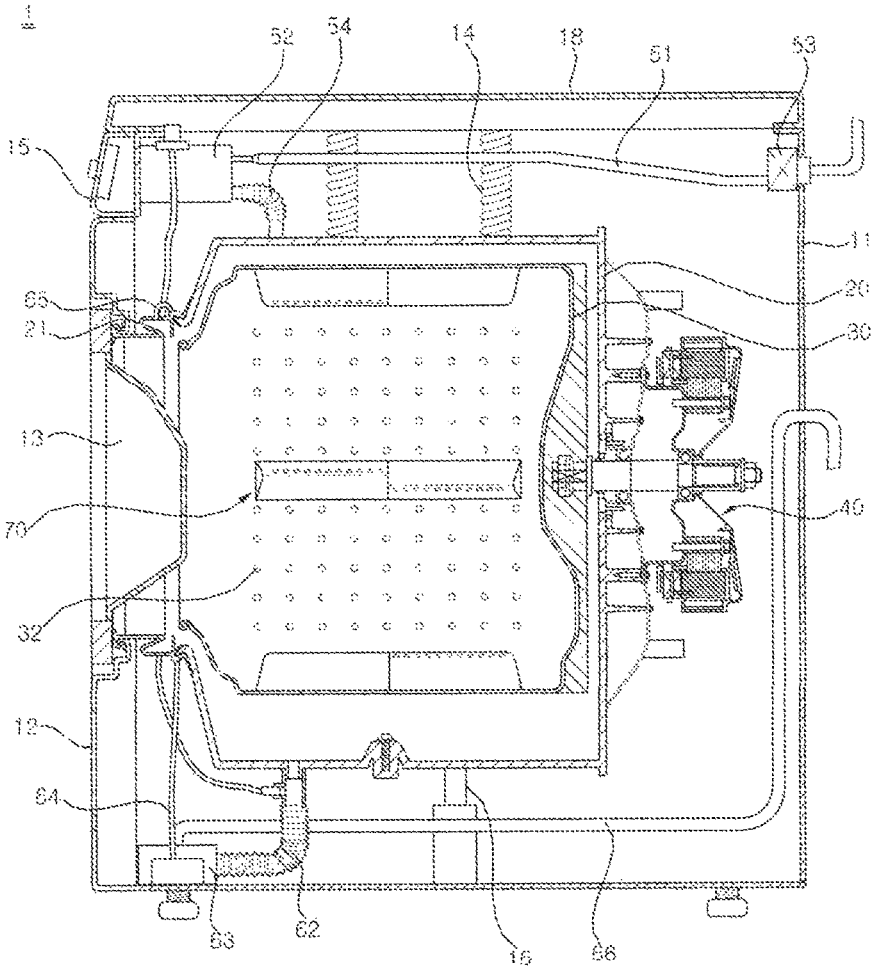
FIG. 1 is a view illustrating a washing machine according to an embodiment of the present application.

Advantages and features of the present application and a method of achieving the same will be more clearly understood from embodiments described below with reference to the accompanying drawings. However, the present application is not limited to the following embodiments but may be implemented in various different forms. The embodiments are provided merely to complete disclosure of the present application and to fully provide a person having ordinary skill in the art to which the present application pertains with the category of the application. The application is defined only by the category of the claims. Wherever possible, the same reference numbers will be used throughout the specification to refer to the same or like parts.

applicationReferring to FIG. 1, a washing machine 1 according to an embodiment of the present application may include a tub 20 disposed inside a casing and holding wash water, a drum 30 disposed inside the tub 20 and rotating while being loaded with laundry, a drive 40 rotating the drum 30, and a controller 15 that controls the operations of components of the washing machine 1.

The casing may include a cabinet 11 having a front side and an upper side opened, a cabinet cover 12 disposed at the front side of the cabinet 11, and a top plate 18 disposed at the upper side of the cabinet 11. The cabinet cover 12 may be provided with a laundry loading opening such that laundry can be loaded/unloaded into/from the drum 30 and a door 13 pivotably disposed at the cabinet cover 12 to open/close the laundry loading hole.

Also, a gasket 21 may be disposed between the inlet of the drum 30 and the laundry loading opening to alleviate a shock delivered to the door 13 during the rotation of the drum 30 and simultaneously prevent a leakage of wash water from the tub 20 to the outside.

A spring 14 and/or a damper 16 may also be provided to absorb vibration during the rotation of the drum 30. The tub 20 may be elastically supported by the spring 14 and/or damper 16 inside the cabinet 11.

The drum 30 may have a plurality of holes 32 such that wash water can flow between the tub 20 and the drum 30. According to an embodiment, a plurality of embosses may protrude from the inner circumferential surface 31 of the drum, and holes 32 may be formed on the embossments.

The drive 40 may rotate the drum 30. The drive 40 may include a motor and a driver controlling the motor. The drive 40 may be controlled by the controller 15 to rotate the drum 30 in various manners. The drum 30 may rotate in a certain direction according to the control of the drive 40. Hereinafter, one rotation direction of the drum 30 will be defined as forward rotation direction, and the other rotation direction of the drum 30 will be defined as backward rotation direction.

A water supply valve 53, a detergent box 52, a water supply hose 51, and a water supply bellows 54 may be disposed in the cabinet 11. The water supply valve 53 may serve to receive wash water from an external water source. The detergent box 52 may contain detergent and/or fabric softener. Wash water and detergent may be mixed in the detergent box 52. The water supply hose 51 may guide wash water introduced through the wash water valve 53 to the detergent box 52. The wash water bellows 54 may supply wash water mixed with detergent or fabric softener in the detergent box 52 into the drum 30.

Also, an outlet hose 62, a pump 63, a circulation hose 64, a nozzle 65, and a drain hose 66 may be disposed in the cabinet 11. The outlet hose 62 may discharge wash water out of the tub 20. The pump 63 may pump wash water out of the tub 20. The circulation hose 64 may guide wash water to the drum 30. The nozzle 65 may be disposed at the gasket 21 to serve to introduce wash water into the drum 30. The drain hose 66 may guide wash water to the outside of the cabinet 11.

The controller 15 may receive inputs of a user, and may control the overall operations of the washing machine. Also, the controller 15 may display a current operation state of the washing machine. The controller 15 may be disposed at an upper portion of the cabinet cover 12. The controller 15 may include a plurality of operation buttons receiving the inputs of a user, a Micom™ controller controlling the operation of the washing machine, and a display device such as a display.

Figure 2:
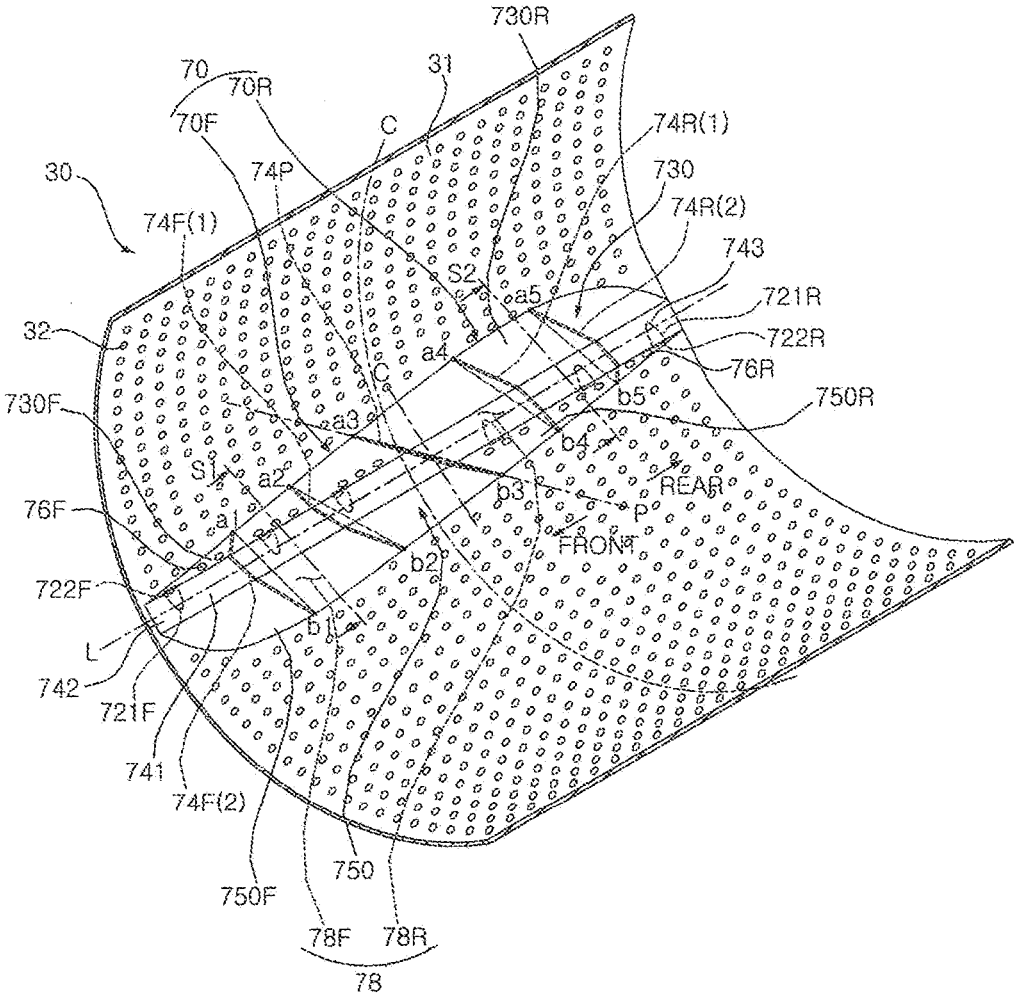
FIG. 2 is a view illustrating a portion of a drum of FIG. 1.
Figure 3:
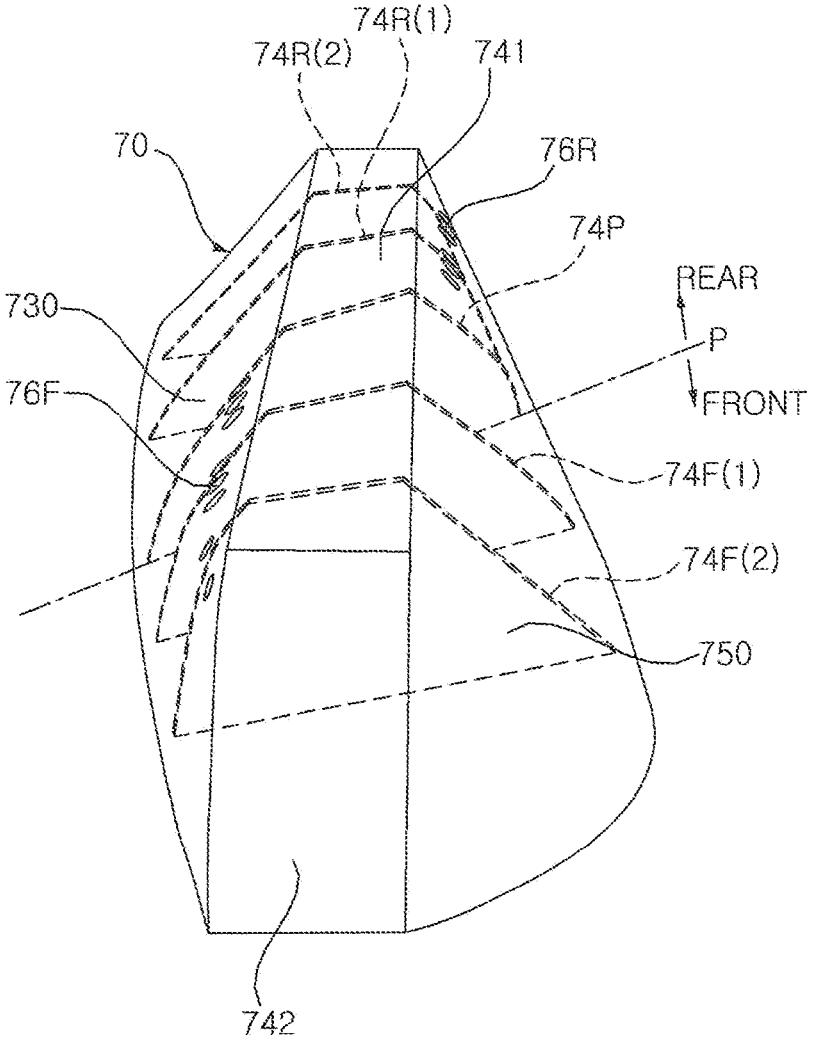
FIG. 3 is a perspective view of a lifter.
Figure 4:
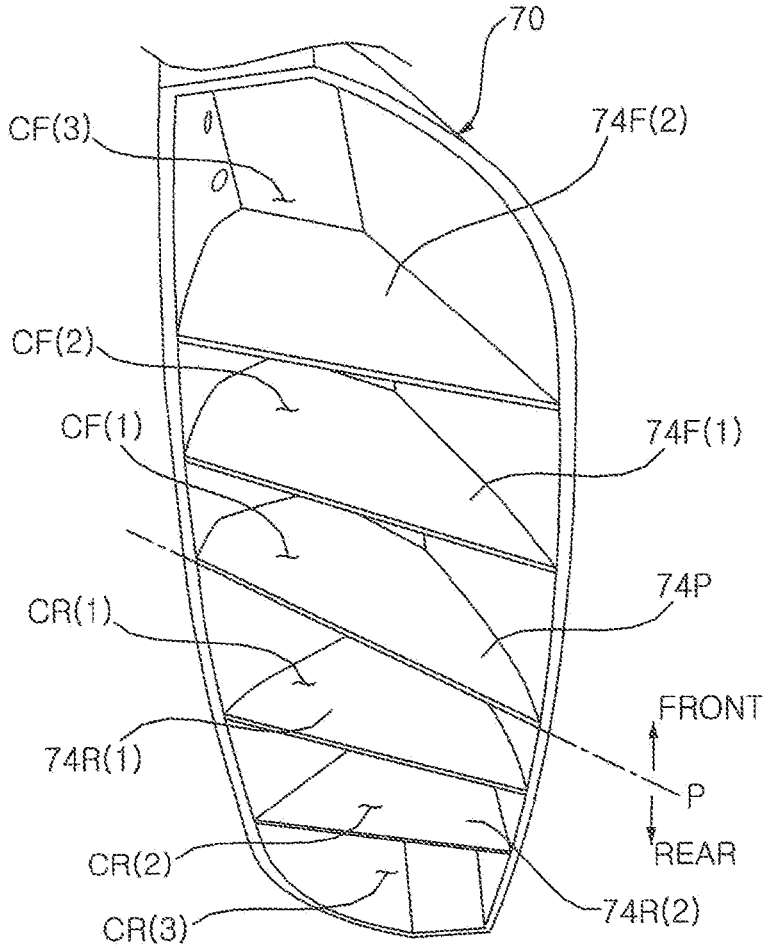
FIG. 4 is a perspective view illustrating the inside of the lifter of FIG. 3 when viewed from the bottom.
Figure 5:
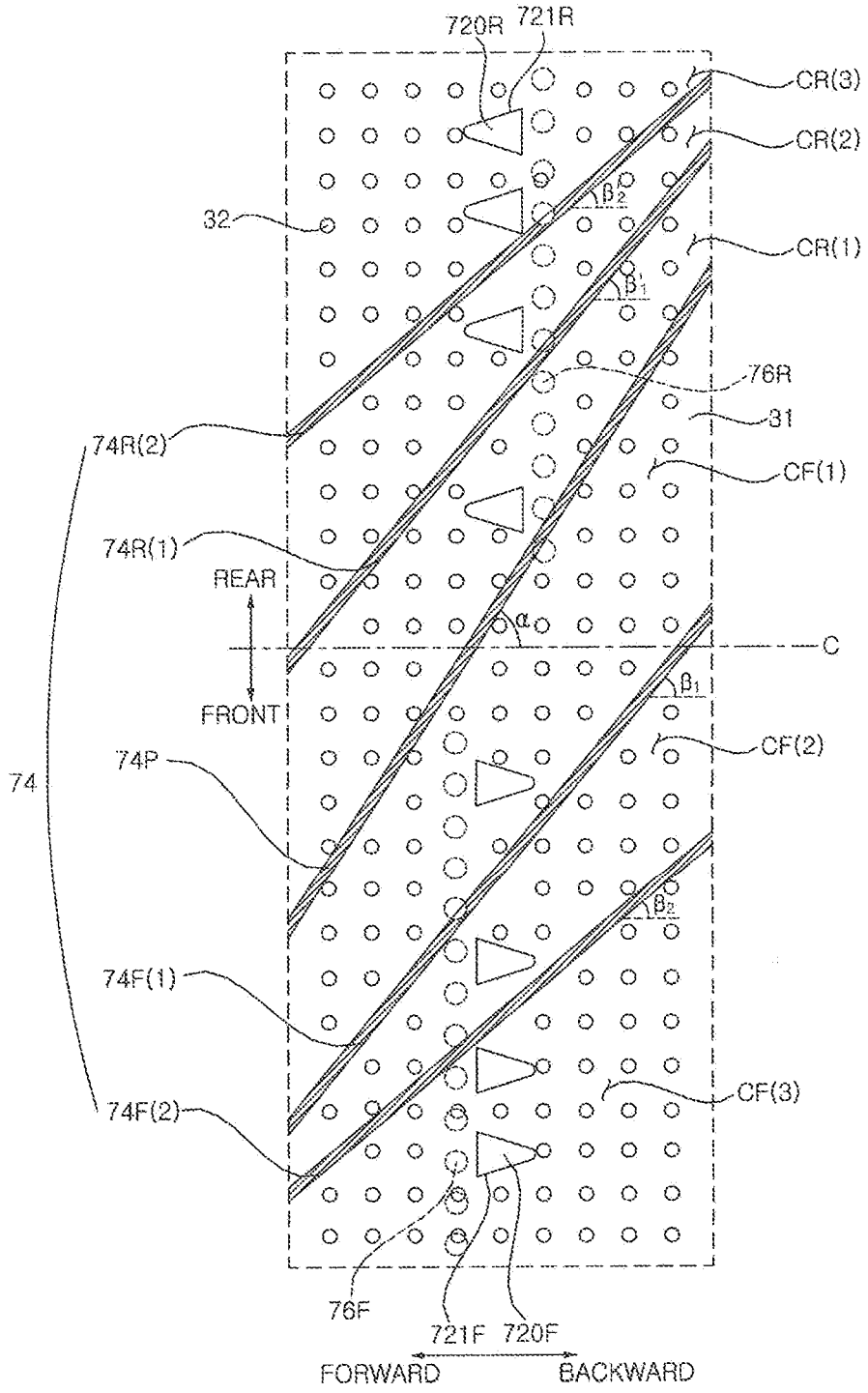
FIG. 5 is a plan view illustrating the inside of the lifter of FIG. 3.
Figure 6:
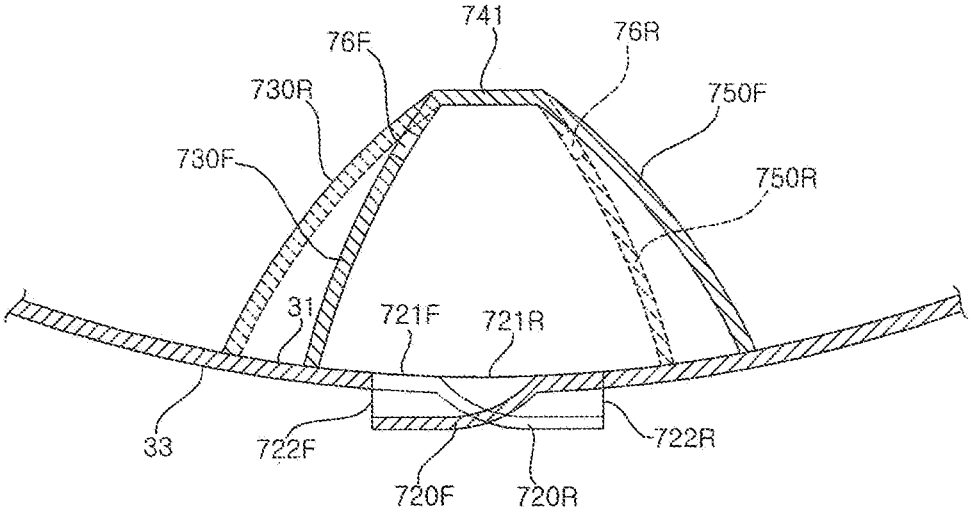
FIG. 6 is a view illustrating overlapped cross-sections taken along S1 and S2 of FIG. 2.

Referring to FIGS. 1, 2, and 5, at least one inlet 721F and 721R may be formed in the drum 30 to receive wash water contained in the tub 20. A plurality of inlets 721F and 721R may be provided. At least a portion of the plurality of inlets 721F and 721R may be arranged along the longitudinal direction of the drum 30. The inlets 721F and 721R may include a front inlet 721F allowing wash water to flow into a front chamber 78F and a rear inlet 721R allowing wash water to flow into a rear chamber 78R.

A lifter 70 may extend along the longitudinal direction from the front side to the rear side of the drum 30, and may form a chamber 78 with the inner circumferential surface 31 of the drum 30. Wash water introduced through the inlets 721F and 721R may be contained in the chamber 78. The lifter 70 may have at least one discharge hole 76F or 76R to discharge wash water inside the chamber 78 into the drum 30. During the rotation of the drum 30, when the location of the lifter 70 reaches a certain height, wash water may be discharged out of the chamber 78 through the discharge holes 76F and 76R. The discharge holes 76F and 76R may be formed to be smaller than the inlets 721F and 721R of the drum or inlets 722F and 722R of scoops 720F and 720R described later.

A plurality of lifters 70 may be provided. In this case, the lifters 70 adjacent to each other may form a certain angle (e.g., about 120 degrees) based on the center of the drum 30. Also, the lifter 70 may serve to draw up laundry during the rotation of the drum 30 as well as to draw up wash water to discharge wash water.

A partition 74P may divide the chamber 78 into the front chamber 78F and the rear chamber 78R along the longitudinal direction of the drum 30. In this case, based on the partition 74P, the lifter 70 may be divided into a front lifter 70F forming the front chamber 78F with the drum 30 and a rear lifter 70R forming the rear chamber 78R with the drum 30. In the drawings, the straight line P may extend along the partition, and the front side (F) and the rear side (R) may be divided based on the straight line P.

The partition 74P may not extend parallelly to the rotational axis or the longitudinal direction of the drum 30, but may extend at a certain angle a with respect to the circumference C of the drum 30. The partition 74P may extend such that a front end a3 thereof obliquely directs to the forward rotation direction of the drum 30 and a rear end b3 thereof obliquely directs to the backward rotation direction of the drum 30. Accordingly, the partition 74P from the front end a3 to the rear end b3 may form an oblique line with respect to the longitudinal direction of the drum 30. As the drum 30 rotates in the forward direction, wash water may be pushed to the backward direction (see FIG. 7A) by an inertia force in the front chamber 78F. In this case, a larger space that can accommodate wash water may be provided at the backward side of the front chamber 78F. Alternately, as the drum 30 rotates in the backward direction, wash water may be pushed to the forward direction by the inertia force in the front chamber 78R. In this case, a larger space that can accommodate wash water may be provided at the forward side of the rear chamber 78R.

In either of the front chamber 78F or the rear chamber 78R divided by the partition 74P, the flow path of wash water may be narrowed from the inlets 721F and 721R to the discharge holes 76F and 76R on the inner circumferential surface 31 of the drum 30. As shown in FIG. 5, the partition 74P may extend at a certain angle with respect to the circumference C of the drum 30, not parallelly to the circumference C of the drum 30. Thus, compared to a case where the partition 74P extends parallelly to the circumference C of the drum 30, when the drum 30 rotates in forward direction, the flow path of wash water on the inner circumferential surface 31 of the drum 30 may be gradually narrowed from the inlet 721F to the discharge hole 76F in the front chamber 78F, reducing the amount of water discharged through the discharge hole 76F and thus holding wash water in the front chamber 78F for a longer time. Alternately, when the drum 30 rotates in backward direction, the flow path of wash water on the inner circumferential surface 31 of the drum 30 may be gradually narrowed from the inlet 721R to the discharge hole 76R in the rear chamber 78R, reducing the amount of water discharge through the discharge hole 76R and thus holding wash water in the front chamber 78R for a longer time.

When the drum 30 rotates in forward direction, the front lifter 70F needs to discharge wash water at a higher height, if possible. To Accomplish this, the front discharge hole 76F formed in the front lifter 70F may be opened toward the forward rotation direction of the drum 30. Such discharge holes may be arranged along the longitudinal direction of the drum 30 such that the front discharge holes 76F may be arranged at the forward side and the rear discharge holes 76R may be arranged at the backward side based on a certain line (e.g., line L of FIG. 2) extending along the longitudinal direction of the drum 30.

Referring FIGS. 2-5, the lifter 70 may include a top surface 741 extending along the longitudinal direction of the drum 30 and first and second side surfaces 730 and 750 that obliquely extend toward the inner circumferential surface 31 of the drum from both sides of the top surface 741, respectively. Also, the front ends of the first and second side surfaces 730 and 750 may be connected to each other by a front surface 742 extending from the top surface 741 to the front side of the drum 30, and the rear ends of the first and second side surfaces 730 and 750 may be connected to each other by a rear surface 743 extending from the top surface 741 to the rear side of the drum 30.

The first side surface 730 may include a portion, the inclination of which decreases or becomes gentler from the front side to the rear side. Here, the inclination may refer to a slope of a boundary between the first side surface 730 and the top surface 741 with respect to the inner circumferential surface 31 of the drum 30. On the other hand, the second side surface 750 may include a portion, the inclination of which becomes steeper from the front side to the rear side. In FIG. 2, a boundary (connection line among a1, a2, a3, a4 and a5) between the first side surface 730 and the inner circumferential surface 31 of the drum 30 may gradually become distant from the centerline L of the top surface 743 as the boundary goes to the rear side of the drum 30. Also, a boundary (connection line among b1, b2, b3, b4 and b5) between the second side surface 750 and the inner circumferential surface 31 of the drum 30 may gradually become closer from the center L of the top surface 743 as the boundary goes to the rear side of the drum 30.

The first side surface 730 may be divided into a front first side surface 730F and a rear first side surface 730R based on the partition 74P. In this case, the front discharge hole 76F may be formed in the front first side surface 730F.

Similarly, the second side surface 750 may be divided into a front second side surface 750F and a rear second side surface 750R based on the partition 74P. In this case, the rear discharge hole 76R may be formed in the rear second side surface 750R.

Meanwhile, the scoops 720F and 720R may protrude from the outer circumferential surface 33 of the drum 30 to guide wash water to the inside of the chamber 78 through the inlets 721F and 721R of the scoops 720F and 720R. A plurality of scoops 720F and 720R may be provided, and may be divided into a front scoop 720F that allows wash water to flow into the front chamber 78F and a second scoop 720R that allows wash water to flow into the rear chamber 78R.

Regardless of the scoops 720F and 720R, when the level of wash water inside the tub 20 reaches a height at which the inlets 721F and 721R are submerged, wash water can be introduced through the inlets 721F and 721R. However, the scoops 720F and 720R may further increase the amount of wash water through the inlets 721F and 721R. Accordingly, when the lifter 70 is located at a lowest position, the water lever of the chamber 78 may become higher than the water level of the tub 20. Also, the scoops 720F and 720R themselves may serve to hold a certain amount of wash water, and may reduce the amount of wash water reversely leaking from the chamber 78 through the inlets 721F and 721R during the rising of the lifter 70 according to the rotation of the drum 30. The reduction of the water leakage may mean that the amount of water discharged through the discharge holes 76F and 76R can increase.

The front scoop 720F may be opened toward the forward rotation direction of the drum 30 such that wash water can be actively introduced into the front chamber 78F during the forward rotation of the drum 30. Alternately, the rear scoop 720R may be opened toward the backward rotation direction of the drum 30 such that wash water can be actively introduced into the rear chamber 78R during the backward rotation of the drum 30.

Separation partitions 74F(1), 74F(2), 74R(1), 74R(2) may divide the chamber 78 into a plurality of flow sections CF(1), CF(2), CF(3), CR(1), CR(2) and CR(3). These separation partitions may include front separation partitions 74F(1) and 74F(2) that divide the front chamber 78F into a plurality of flow sections CF(1), CF(2) and CF(3) and rear separation partitions 74R(1) and 74R(2) that divide the rear chamber 78R into a plurality of flow sections CR(1), CR(2) and CR(3).

The separation partitions 74F(1), 74F(2), 74R(1) and 74R(2) may connect between the drum 30 and the lifter 70. Each of the flow sections CF(1), CF(2), CF(3), CR(1), CR(2) and CR(3) may be provided with at least one inlet 721F or 721R for inflow of wash water into the corresponding flow section and at least one discharge hole 76F or 76R for discharge of wash water out of the corresponding flow section.

The flow sections CF(1), CF(2), CF(3), CR(1) and CR(2) divided by the separation partitions 74F(1), 74F(2), 74R(1) and 74R(2) may be formed such that the flow path of wash water on the inner circumferential surface 31 of the drum 30 becomes narrower from the inlets 721F and 721R to the discharge holes 76F and 76R. Similarly to the partition 74P, the front ends of the separation partitions 74F(1), 74F(2), 74R(1) and 74R(2) may obliquely directs to the forward rotation direction, and the rear ends thereof may obliquely directs to the backward rotation direction.

Furthermore, angles between the circumference C of the drum 30 and the separation partitions 74F(1) and 74F(2) dividing the front chamber 78F may gradually decrease from the partition 74P to the front side of the drum 30 ($\beta 1 > \beta 2$), and similarly, angles between the circumference C of the drum 30 and the separation partitions 74R(1) and 74R(2) dividing the rear chamber 78R may gradually decrease from the partition 74P to the rear side of the drum 30 ($\beta'1 > \beta'2$), such that the flow section CF(1) or CR(1) between the partition 74P and the partition 74F(1) or 74R(1) or the flow section CF(2) or CR(2) between adjacent separation partitions (between the separation partitions 74F(1) and 74F(2) or between the separation partitions 74R(1) and 74R(2)) is gradually narrowed in flow path of wash water on the inner circumferential surface 31 of the drum 30 from the inlet 721F or 721R to the discharge hole 76F or 76R.

Figure 7A:
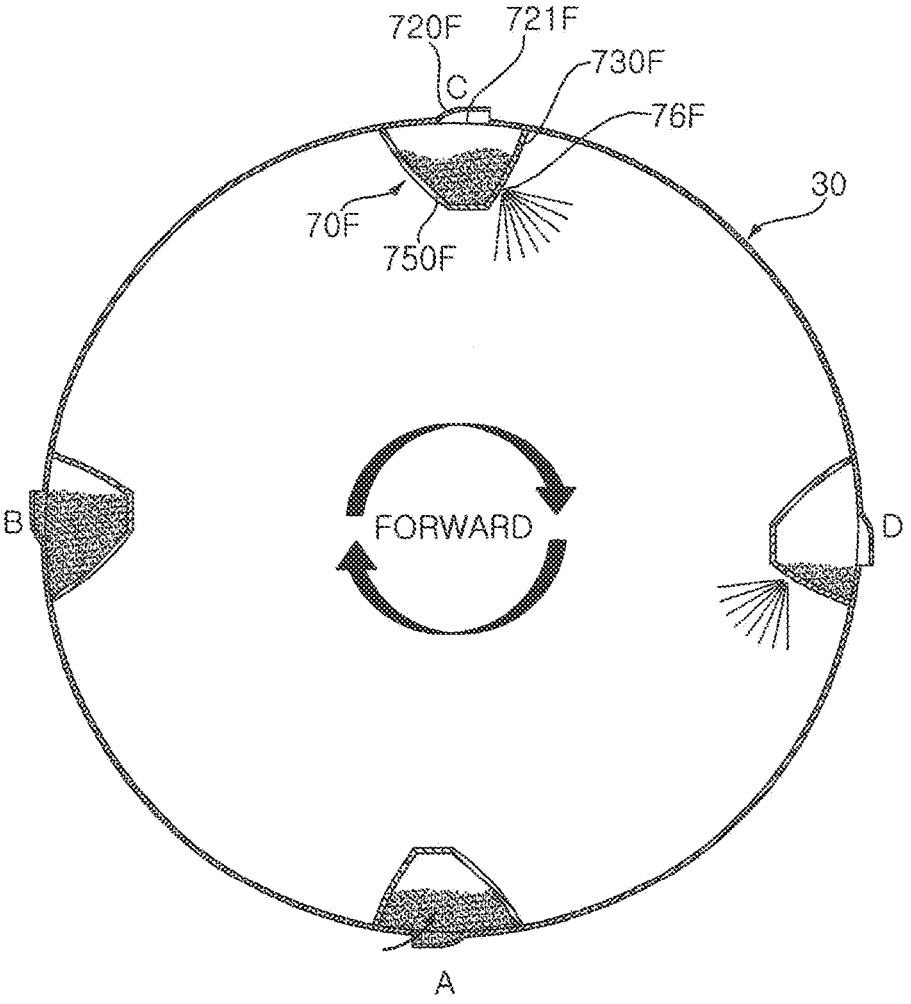
Figure 7B:
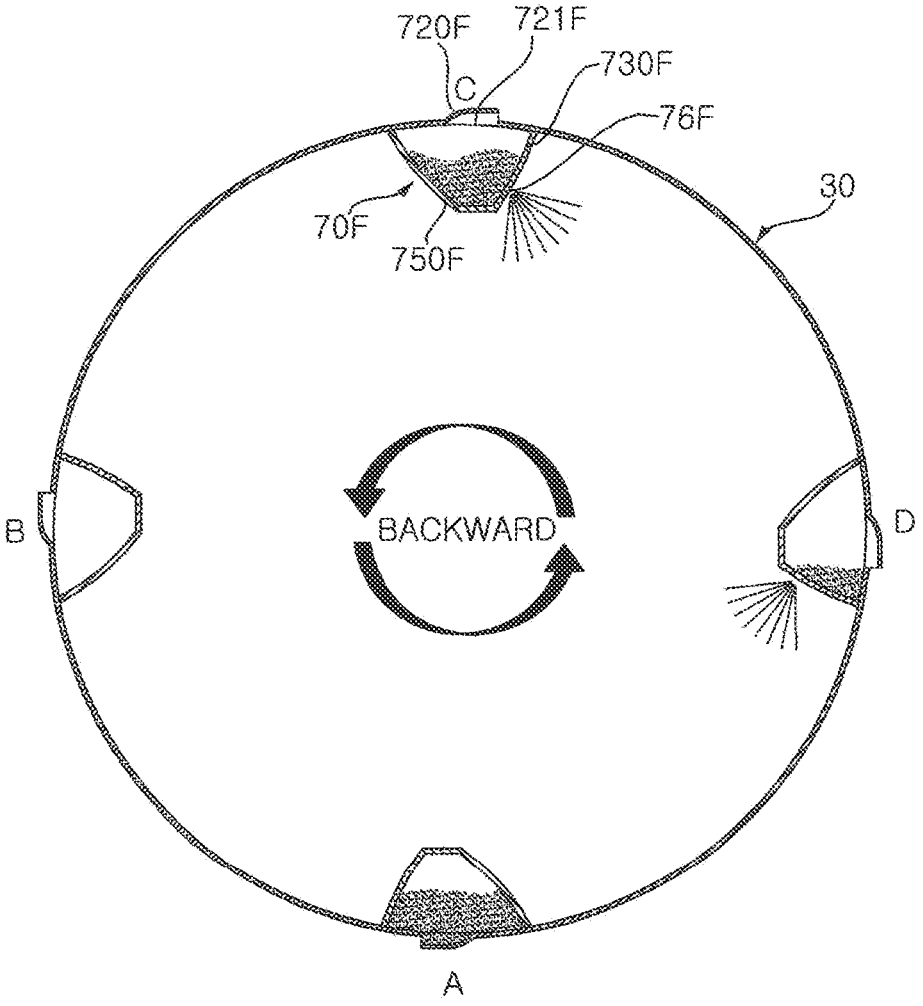

FIGS. 7A and 7B are views illustrating a position change of the front lifter 70F according to a rotation of the drum 30, in which FIG. 7A shows a position change during the forward rotation of the drum 30 and FIG. 7B shows a position change during the backward rotation of the drum 30.

Referring to FIG. 7A, when the drum 30 rotates in the forward direction, wash water may flow into the front chamber 78F through the front scoop 720F at the lowest location of the front lifter 70F. The water level inside the tub 20 needs to reach a level at which the scoop 720F can be submerged even at the lowest location, and preferably, may be higher than the height of the inlet 721F.

A location B may be any point while the front lifter 70F is rising according to the rotation of the drum 30. The location B is a location where the discharge of wash water through the front discharge hole 76F does not yet occur. Thereafter, as the drum 30 continuously rotates, the location of the front lifter 70F may rise to the highest point (location C). In this case, the height of the front discharge hole 76F may become lower than the water lever of the front chamber 78F, allowing wash water to be discharged through the front discharge hole 76F.

A location D may be any point while the front lifter 70F is falling according to the rotation of the drum 30. At this point, the discharge of wash water through the front discharge hole 76F may occur.

During the rotation of the drum 30, wash water inside the front chamber 78F intends to be pushed to the opposite direction to the rotation direction of the drum by an inertia force. Accordingly, the amount of wash water discharged through the front discharge hole 76F may be influenced by the rotation speed of the drum 30.

The washing machine 1 may variously change the rotation speed of the drum 30 during the operation thereof, thereby variously changing the position of laundry inside the drum 30 and thus removing contaminants from the laundry. In this case, since the rotation speed of the drum 30 relates to a centrifugal force acting on laundry, the maximum rising height of laundry immediately before laundry drops may vary with the rotation speed of the drum 30.

For example, the rotation speed of the drum may be controlled to be about 50 rpm during a washing operation, and in the technical field of washing machine, the rotation speed of about 50 rpm may be significantly lower than the laundry adhesion speed (about 100 rpm) in which the drum 30 rotates while laundry is adhering to the inner surface of the drum 30. Accordingly, laundry lifted by the rotation of the drum 30 may drop at a certain height, thereby enabling the washing of laundry by a physical impact upon drop. This washing operation may be performed while wash water (hereinafter, referred to as detergent water) dissolved with detergent is contained in the tub 20. During the rotation of the drum 30, since detergent water circulates into the tub 20 after sequentially passing through the tub 20, the inlets 721F and 721R, the chamber 78, the discharge holes 76F and 76R, and the drum 30, detergent can be uniformly mixed in this circulation process, and detergent water discharged through the discharge holes 76F and 76R may directly hit on laundry, thereby improving the washing performance.

Alternately, a laundry soaking operation may be exemplified as a case where the rotation speed of the drum 30 is controlled to be lower than the speed of the washing operation. The laundry soaking operation may be focused on sufficient soaking of laundry in wash water instead of considering an impact upon drop of laundry. In this case, the rotation speed of the drum 30 may be controlled to be lower (e.g., about 30 rpm) such that laundry can be evenly dispersed at a lower part of the drum 30. During the laundry soaking operation, since the rotation cycle is longer than that of the washing operation and thus the amount of wash water discharged through the discharge holes 76F and 76R for one rotation cycle is larger than that of the washing operation, laundry can be effectively soaked.

Referring to FIG. 7B, when the drum 30 rotates in the backward direction, the front lifter 70F may sequentially pass the locations A, D, C and B.

At the lowest point (location A), wash water may flow into the front chamber 78F through the inlet 721F. The water level inside the tub 20 may be higher than the height of the inlet 721F. In this case, although the opened direction of the front scoop 720F is opposite to the rotation direction of the drum 30, wash water may be slightly introduced through the inlets 721F and 721R.

The location D may be any point while the front lifter 70F is rising according to the rotation of the drum 30. At this point, wash water may be discharged through the front discharge hole 76F.

Thereafter, as the drum 30 continuously rotates, the front lifter 70F may fall passing through the highest point (location C). While the front lifter 70F is falling passing a certain location, the discharge of wash water through the front discharge hole 76F may be stopped. The location B shows that wash water is not discharged any more through the front discharge hole 76F at the falling section of the front lifter 70F.

During the backward rotation of the drum 30, since the wash water is pushed to the front first side surface 730F having the front discharge hole 76F formed therein by an inertia force, most wash water inside the front chamber 78F may be discharged for one rotation cycle of the drum 30. At the location B of FIG. 7B, all wash water inside the front chamber 78F may be discharged during the falling of the front lifter 70F.

Figure 8A:
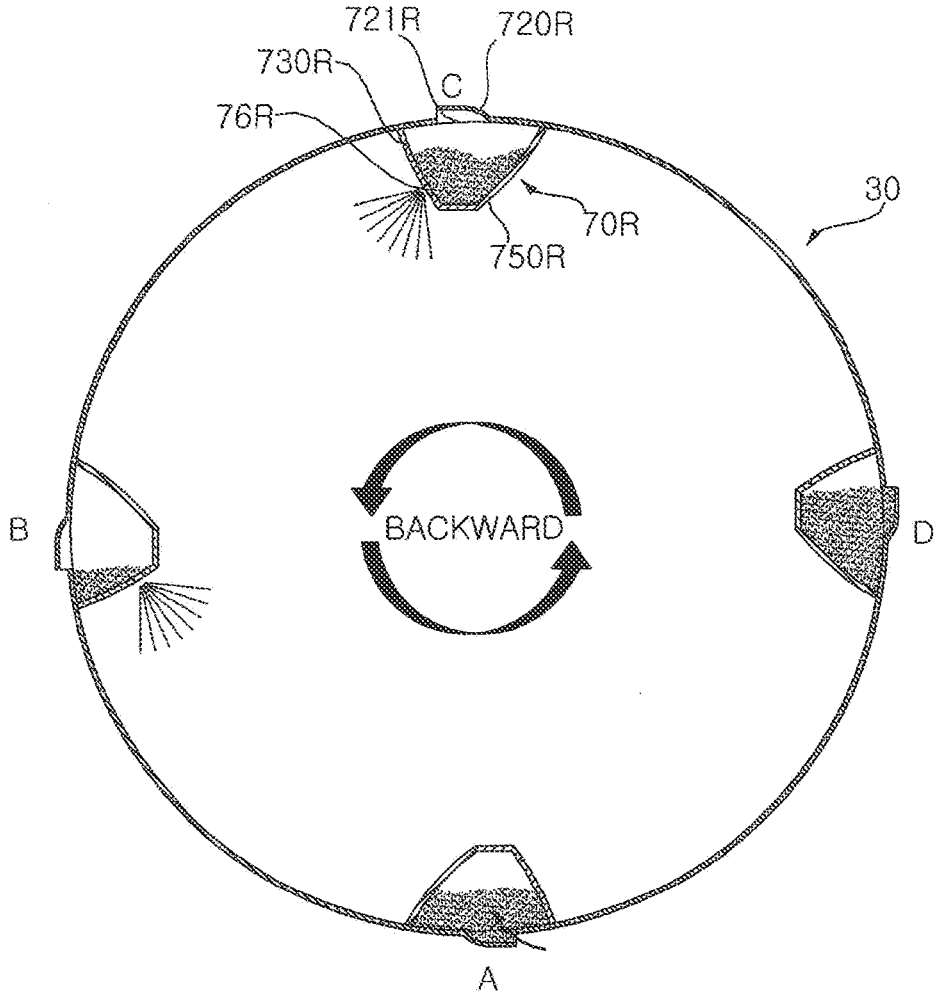

FIG. 8 is a view illustrating a position change of the rear lifter 70R according to the rotation of the drum 30, in which 8A shows a position change during the backward rotation of the drum 30 and 8B shows a position change during the forward rotation of the drum 30. Compared to FIG. 7, since FIG. 8 may be similar in principle except that water storage or discharge is performed by the front lifter 70R, a detailed description thereof will be omitted. Hereinafter, effects derived from an interaction between the front lifter 70F and the rear lifter 70R during the rotation of the drum 30 will be described in consideration of FIGS. 7 and 8.

Figure 8B:
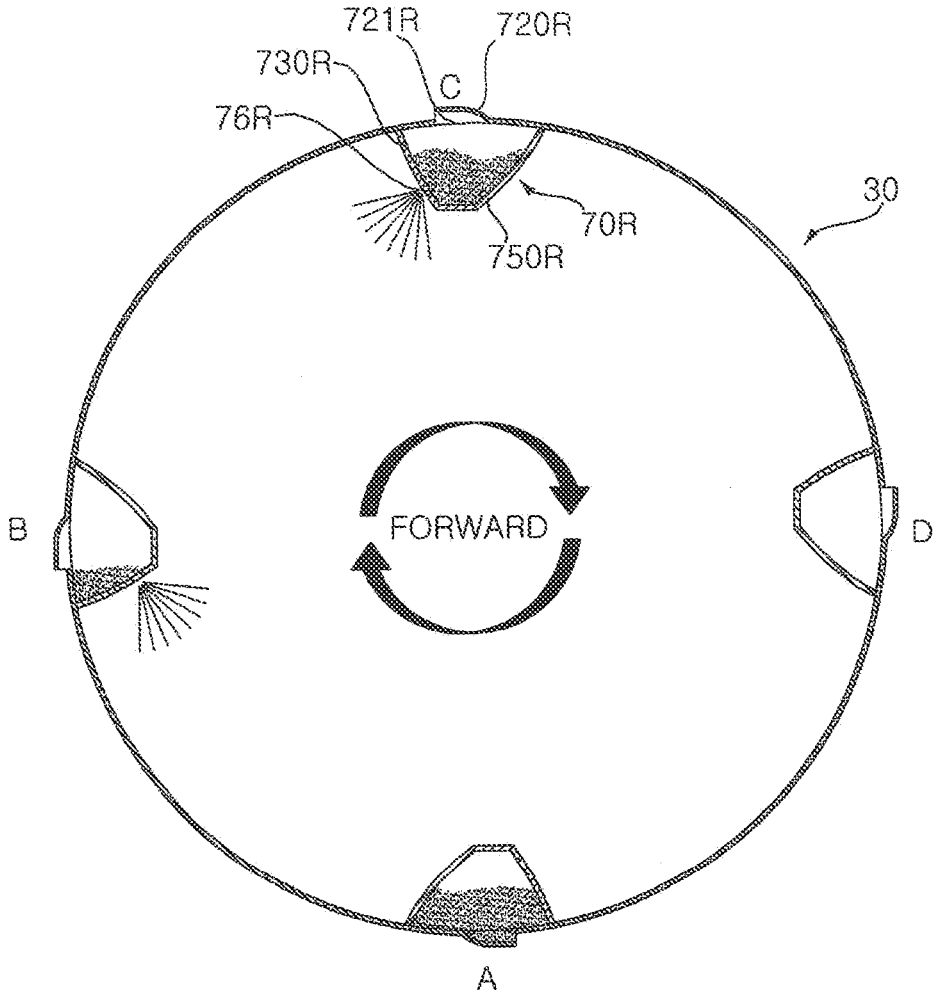

As shown in FIG. 7A, when the drum 30 rotates in the forward direction, wash water contained in the front chamber 78F may be discharged at the location D but may not be discharged at the location B. On the other hand, as shown in FIG. 8B, wash water contained in the rear chamber 78R may not be discharged at the location D, but may be discharged at the location B. That is, since wash water contained in the front chamber 78F and wash water contained in the rear chamber 78R may not be discharged in the same pattern but in a certain section where wash water contained in one chamber is not discharged, wash water contained in the other chamber may be discharged, a section where the discharge of wash water is stopped during the rotation of the drum 30 can be minimized, or wash water may be continuously discharged without a section where the discharge of wash water is stopped.

Similarly, when the drum 30 rotates in the backward direction, wash water may be complementarily discharged out of the front chamber 78F and the rear chamber 78R, which can be seen by comparing FIGS. 7 and 8.

The present application provides a washing machine, which can forcibly generate a flow of wash water by drawing up wash water and then discharging wash water into a drum during the rotation of the drum and can perform this forcible flow for a longer time during the rotation cycle of the drum.

The present application also provides a washing machine, which can continuously discharge wash water from a front chamber and a rear chamber during the rotation of a drum by allowing the front and rear chambers to complementarily discharge wash water.

The present application also provides a washing machine, which can more uniformly dissolve detergent in wash water inside a tub.

According to an aspect of the present application, there is provided a washing machine including: a tub containing wash water; a drum rotating inside the tub and having at least one inlet to introduce wash water contained in the tub; a lifter forming a chamber holding wash water introduced through the at least one inlet together with the drum and discharging wash water into the drum through a plurality of discharge holes arranged from a front side to a rear side inside the chamber during the rotation of the drum; and a partition dividing the chamber into a front chamber and a rear chamber along a longitudinal direction of the drum and forming an angle inclined with respect to a circumference of the drum.

According to another aspect of the present application, there is provided a washing machine including: a tub containing wash water; a drum rotating inside the tub and having at least one inlet to introduce wash water contained in the tub; a lifter rotating integrally with the drum and drawing up wash water introduced through the at least one inlet to discharge wash water into the drum; and a partition forming a boundary dividing an internal space of the lifter containing wash water introduced through the inlet into a front chamber and a rear chamber, the boundary forming an angle inclined with respect to a circumference of the drum.

The foregoing and other objects, features, aspects and advantages of the present application will become more apparent from the following detailed description of the present application when taken in conjunction with the accompanying drawings.

Any reference in this specification to "one embodiment," "an embodiment," "example embodiment," and the like, means that a particular feature, structure, or characteristic described in connection with the embodiment is included in at least one embodiment of the application. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a tub configured to hold water;

a rotatable drum disposed in the tub, the drum having an inlet formed on an outer circumferential surface of the drum to receive water contained in the tub; and a lifter extending inwardly from the an inner circumferential surface of the drum, the lifter together with the inner circumferential surface of the drum forming a chamber that holds water received through the inlet, the lifter having a discharge hole through which water within the chamber is discharged during the rotation of the drum, the lifter including a partition dividing the chamber into a front chamber and a rear chamber along a longitudinal direction of the drum, the partition disposed at an oblique angle with respect to longitudinal axis of the drum, wherein an edge of the partition is attached to the inner circumference of the drum and wherein a first end of the edge is closer to a front of the drum, and a second end opposite the first end is closer to a rear of the drum.

2. The washing machine of claim 1, wherein the lifter includes a plurality of lifters, and wherein the partition comprises a front end obliquely directing to a forward rotation direction of the drum and a rear end obliquely directing to a backward rotation direction of the drum.

3. The washing machine of claim 2, wherein the partition is formed such that a flow path of water in the chamber gradually becomes narrower from inlet to discharge hole.

4. The washing machine of claim 1, wherein the discharge hole comprises a plurality of discharge holes in the front chamber opening in a forward rotation direction of the drum and a plurality of discharge holes in the rear chamber opening in a backward direction of the drum.

5. The washing machine of clam 1, wherein the inlet comprises a plurality of inlets disposed along the longitudinal direction of the drum.

6. The washing machine of claim 1, further including a scoop protruding from the outer circumferential surface of the drum to draw water in the tub into the lifter and in fluid communication with the inlet.

7. The washing machine of claim 6, wherein the inlet includes a plurality of inlets disposed along the longitudinal direction of the drum and wherein the scoop comprises:

a front scoop in fluid communication with at least one of the inlets and opening toward a forward rotation direction of the drum to draw water into the front chamber and a rear scoop in fluid communication with at least an other of the inlets and opening toward a backward rotation direction of the drum to draw water into the rear chamber.

8. The washing machine of claim 1, wherein the partition extends between the inner circumferential surface of the drum and an inner surface of the lifter.

9. The washing machine of claim 1, further including a separation partition dividing the front chamber or the rear chamber into a plurality of flow sections.

10. The washing machine of claim 9, wherein the separation partition connects between the inner circumferential surface of the drum and an inner surface of the lifter, the inlet includes a plurality of inlets, the discharge hole includes a plurality of discharge holes, and some of the inlets and some of the discharge holes are provided to correspond to each flow section.

11. The washing machine of claim 10, wherein the flow sections are formed such that a flow path of water becomes narrower from the inlets to the discharge holes.

12. The washing machine of claim 10, wherein the separation partition includes a plurality of separation partitions forming a plurality of the flow sections divided by the separation partitions.

13. The washing machine of claim 1, wherein the lifter includes a first side surface and a second surface, the side surfaces extend at an oblique angle inclined with respect to the inner circumferential surface of the drum, and an inclination angle of the first side surface decreases from a front side to a rear side of the chamber and an inclination angle of the second side surface becomes steeper from the front side to the rear side of the chamber.

14. The washing machine of claim 13, wherein the discharge hole includes a plurality of front discharge holes formed in a front side portion of the first side surface based on a location of the partition and a plurality of rear discharge holes formed in a rear site portion of the second side surface based on the location of the partition.

15. The washing machine of claim 14, wherein the front discharge holes are provided on the fronts side portion and the rear discharge holes are provided the rear side portion, the front discharge holes are arranged along the longitudinal direction of the drum to discharge water out of the front chamber, and the rear discharge holes are arranged along the longitudinal direction of the drum to discharge water out of the rear chamber.

16. The washing machine of claim 1, wherein when one of the front chamber and the rear chamber is stopped from discharging water during a frontward rotation of the drum, the other chamber discharges water during a backward rotation of the drum.

17. A washing machine comprising:

a tub configured to hold water;

a rotatable drum disposed in the tub, the drum having a plurality of inlets formed on an outer circumferential surface of the drum to receive water contained in the tub;

a plurality of lifters extending inwardly from an inner circumferential surface of the drum, each lifter inlets together with the drum forming a chamber that holds water received through the inlets, each lifter having a plurality of front discharge holes and a plurality of rear discharge holes through which water within the chamber is discharged during the rotation of the drum; and partitions extending between the inner circumferential surface of the drum and an inner surface of each lifter and dividing each chamber into a front chamber and a rear chamber along a longitudinal direction of the drum and forming an oblique angle with respect to a longitudinal axis of the drum, each partition including an edge attached to the inner circumferential surface of the drum, wherein a first end of the edge is closer to a front of the drum, and a second end of the edge opposite the first end is closer to a rear of the drum, each partition being formed such that a flow path of water in each chamber gradually becomes narrower from inlet to discharge hole, the front discharge holes being disposed in the front chamber opening in the forward rotation direction of the drum and the plurality of discharge holes being disposed in the rear chamber opening in the backward direction of the drum.

18. The washing machine of claim 1, further including a scoop protruding from an outer circumferential surface of the drum to draw water in the tub into each lifter and in fluid communication with the inlet, the scoop including:

a front scoop in fluid communication with at least one of the inlets and opening toward the forward rotation direction of the drum to draw water into die front chamber and a rear scoop in fluid communication with at least an other of the inlets and opening toward a backward rotation direction of the drum to draw water into the rear chamber.

19. The washing machine of claim 18, further including a separation partition dividing the front chamber or the rear chamber into a plurality of flow sections, wherein the separation partition connects between the inner circumferential surface of the drum and the inner surface of the lifter, wherein some of the inlets and some of the discharge holes are disposed to correspond to each flow section.

20. The washing machine of claim 19, wherein each lifter includes a first side surface and a second surface, the side surfaces extend at an oblique angle inclined with respect to the inner circumferential surface of the drum, and an inclination angle of the first side surface decreases from a front side to a rear side of the chamber and an inclination angle of the second side surface becomes steeper from the front side to the rear side of the chamber, wherein the front discharge holes are disposed on the front side portion and the rear discharge holes are disposed the rear side portion, the front discharge holes are arranged along the longitudinal direction of the drum to discharge water out of the front chamber.

21. The washing machine of claim 1, wherein the lifter is parallel to the longitudinal axis.

* * * * *